United States Patent [19]

Cotterman et al.

[11] Patent Number: 4,471,360

[45] Date of Patent: Sep. 11, 1984

[54] ANTENNA WITH ARTICULATED DIPOLE ELEMENT

[75] Inventors: Robert W. Cotterman, Sunnyvale; Joseph E. Bert, Fremont, both of Calif.

[73] Assignee: GTE Products Corporation, Stamford, Conn.

[21] Appl. No.: 387,576

[22] Filed: Jun. 10, 1982

[51] Int. Cl.[3] ..... H01Q 1/08

[52] U.S. Cl. ..... 343/805; 343/880

[58] Field of Search ..... 343/715, 880, 881, 882, 343/900, 805

[56] References Cited

U.S. PATENT DOCUMENTS

| | | | |
|---|---|---|---|
| 2,706,608 | 4/1955 | Joseph | 343/882 |
| 3,427,769 | 2/1969 | Star | 343/900 |
| 3,587,103 | 6/1971 | Lawrie et al. | 343/709 |
| 3,624,662 | 11/1971 | Feder | 343/882 |
| 3,950,758 | 4/1976 | Mirrione et al. | 343/881 |

*Primary Examiner*—Eli Lieberman

*Attorney, Agent, or Firm*—John F. Lawler

[57] ABSTRACT

An articulated element for an antenna such as a log-periodic dipole antenna having an elongated boom comprises an inner tubular section secured to the boom and an outer tubular section movable relative to the inner section between an extended or operative position colinear with the inner section to a folded or inoperative position transversely of the inner section. The element sections are interconnected by spring means which is always in tension and exerts a compressive force between the two sections for good electrical conductivity when in the operative position while permitting the outer section readily to be pivoted to the stowed position. A T-shaped sleeve secured to the inner section has slotted longitudinal and transverse legs which releasably clamp and provide strong mechanical support of the outer section in both positions.

8 Claims, 9 Drawing Figures

ANTENNA WITH ARTICULATED DIPOLE ELEMENT

RELATED APPLICATION

Ser. No. 387,575, filed Jun. 10, 1982.

BACKGROUND OF THE INVENTION

This invention relates to antennas and more particularly to a foldable log-periodic antenna.

The use of communications and other electronic equipment in the field often requires the positioning of a log-perodic antenna at heights of 18 feet or more above the ground in order to prevent ground interference with signals being radiated or received by the antenna. In the case of portable tactical military systems it is essential that such an antenna be elevated from a stowed position on the transporting vehicle to the operative position quickly and with a minimum of personnel, ideally one person. In addition, the antenna and its support in the stowed position on the vehicle should be sufficiently compact as to not interfere with mobility of the vehicle in the field or on heavily trafficked roads.

An erectable log-periodic antenna system of the general type mentioned above has been built in the past but has several disadvantages. The antenna boom comprises three separate pieces. The 36 radiating elements are removably secured to the boom and are bundled together for stowing. The mast has several separate sections which are coupled together and the antenna is mounted on top of the mast after the latter has been raised to the vertical position. The disadvantages of this system are excessive assembly time, the large number of separate pieces and the complex assembly procedure leads to loss of parts and unreliability, difficulty of assembly especially in snow and mud, at least two operators are required to assemble and disassemble the system, and assembly of the system requires a large amount of open space around the supporting vehicle.

This invention is directed to an improved antenna that overcomes the above mentioned disadvantages.

OBJECTS AND SUMMARY OF THE INVENTION

A general object of the invention is the provision of a foldable log-periodic antenna which is integrated, that is, all parts of the antenna are connected together at all times.

A further object is the provision of such an antenna which is rugged, light weight and economical to produce.

These and other objects of the invention are achieved with an integrated log-periodic antenna having a boom with permanently connected articulated radiating elements comprising inner and outer sections, the latter being manually foldable from the extended operative positions perpendicular to the boom to stowed positions parallel to the boom. The outer section of each articulated element is firmly releasably clamped in both operative and stowed positions and is tightly coupled to the inner section in the operative position to insure a good electrical connection therewith.

DESCRIPTION OF PREFERRED EMBODIMENTS

Figure 1:
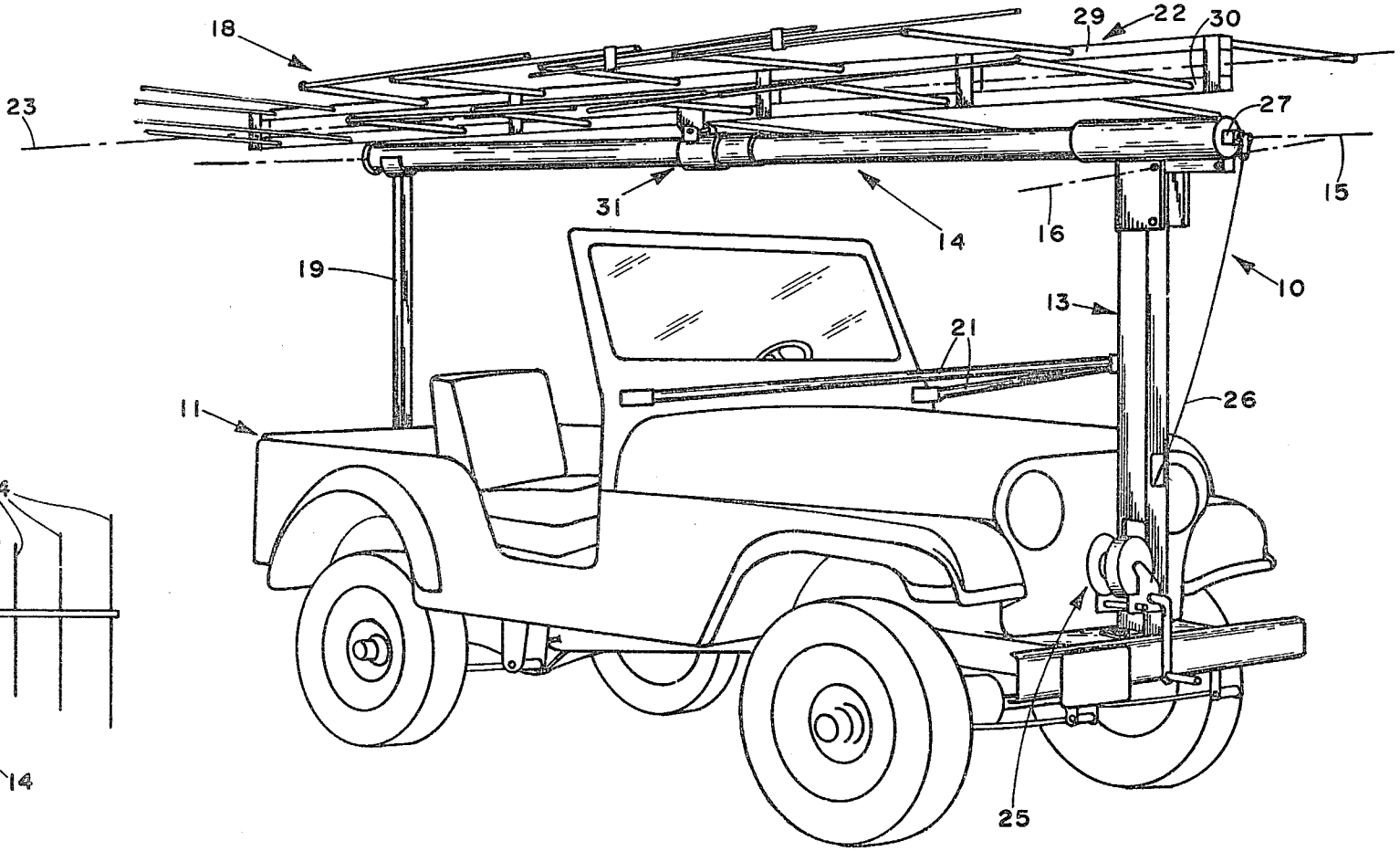
FIG. 1 is a perspective view of an antenna system embodying the invention mounted on a standard military vehicle and shown in the stowed position.
Figure 2:
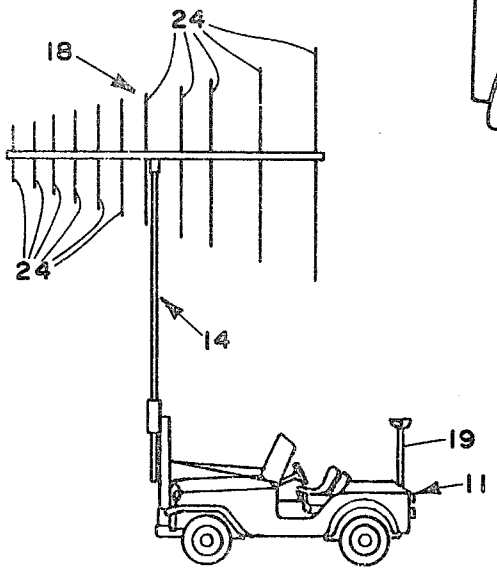
FIG. 2 is a perspective view of the vehicle-mounted antenna system shown in the operative position.

Referring now to the drawings, a preferred embodiment of the invention is shown in FIGS. 1 and 2 as an antenna system 10 mounted on a vehicle 11 in an inoperative or stowed position (FIG. 1) and in an operative position (FIG. 2). The system 10 comprises a vertical post 13 supported on a platform comprising the front portion of the vehicle frame, a mast 14 having a longitudinal axis 15 and pivotally connected to post 13 for rotation about axis 16, and an antenna assembly 18 supported on mast 14. A vertical brace 19 secured to the rear frame of the vehicle 11 supports the opposite or free end of mast 14 in the horizontal or stowed position as shown in FIG. 1. Rods 21 connected to the vehicle body and the central part of post 13 reinforce the latter.

Figure 3:
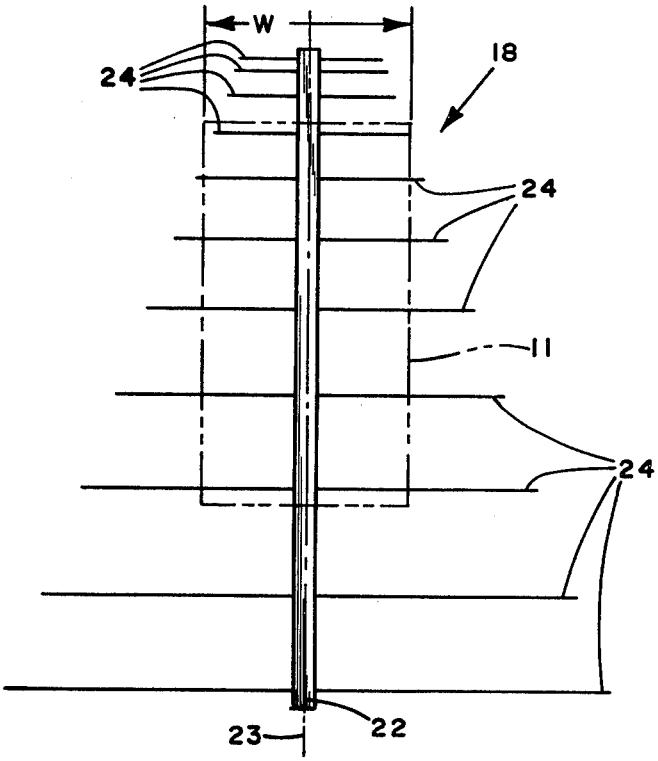
FIG. 3 is a plan schematic view of the log-periodic antenna of this invention showing the radiating elements in their operative or extended positions.

Antenna assembly 18 has a boom 22 with a longitudinal axis 23 and to which a plurality of longitudinally spaced dipoles 24 are connected, see FIGS. 2 and 3. The antenna may, by way of example, comprise a log-periodic structure as shown. A log-periodic antenna used in an embodiment of this invention has a boom 13 feet long with 14 dipoles (28 elements) having lengths ranging from 157 inches at the low frequency (20 MHz) and 49 inches at the high frequency (80 MHz) end. This antenna was mounted on a mast 12 feet in length pivoted on a post extending 6 feet above the ground.

Post 13 is a hollow tubular structure bolted at its bottom to the front frame of vehicle 11. A hand-operated winch 25 secured to the base of post 13 is connected by cable 26 to an extendible arm 27 in the pivoted end of mast 14 for elevating and lowering mast 14 between horizontal and vertical positions.

Boom 22 of antenna assembly 18 comprises elongated coextensive parallel conductive preferably square tubes 29 and 30, secured in spaced relation by a plurality of longitudinally spaced nonconductive straps 66 riveted to opposite sides of the tubes throughout their lengths. Each dipole has two elements **24*a* and 24*b* connected to and projecting in opposite directions from conductive tubes 29 and 30, respectively, with the elements of longitudinally adjacent dipoles connected to the same conductive tube projecting in opposite directions. The purpose of this arrangement is to provide a 180 degree phase change in the feed to adjacent dipoles, a well-known requirement for end fire radiation of a log-periodic antenna. Tubes 29 and 30, in addition to mechanically supporting the dipole elements, are electrical feed conductors for these elements. The antenna is energized by balanced feed lines, not shown, connected to the ends of tubes 29 and 30, respectively, adjacent the smallest dipole, i.e., the left end as viewed in FIG. 2**.

Boom 22 is supported on mast 14 by a hinge mechanism 31 which is slidable on mast from its midpoint as shown in FIG. 1 to the left end (as viewed) of the mast. Hinge mechanism 31 enables boom 22 to pivot between the stowed position parallel to the mast to the operative position perpendicular to the mast as shown in FIG. 2.

Details of construction of mast 14 and hinge mechanism 31 are more fully described in copending application Ser. No. 387,575.

Figure 4:
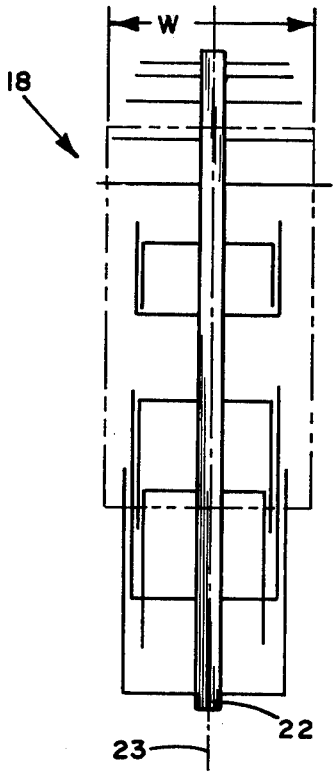
FIG. 4 is a view similar to FIG. 6 showing the radiating elements in collapsed or stowed position.
Figure 5:
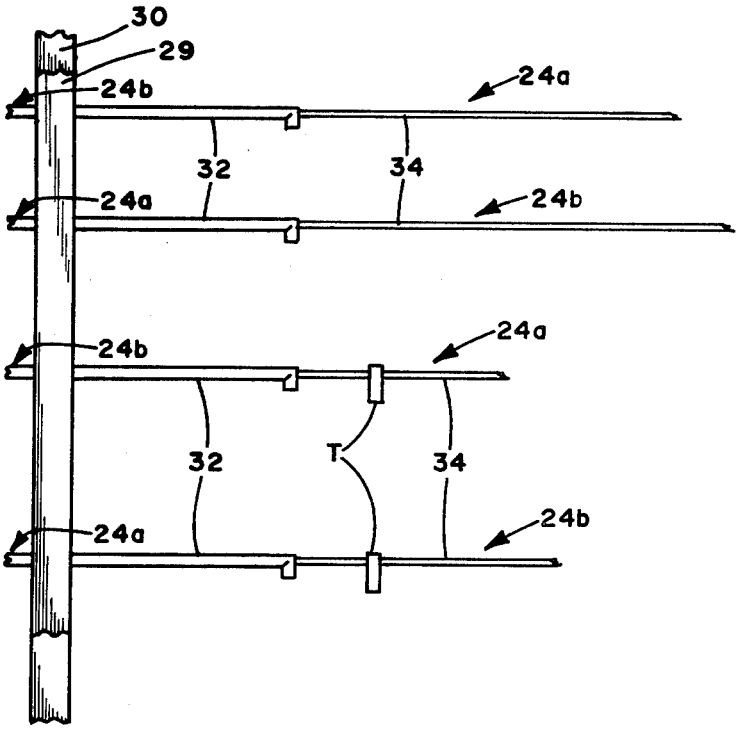
FIGS. 5 and 6 are fragmentary views of the antenna showing radiating elements in the operative and stowed positions, respectively.
Figure 6:
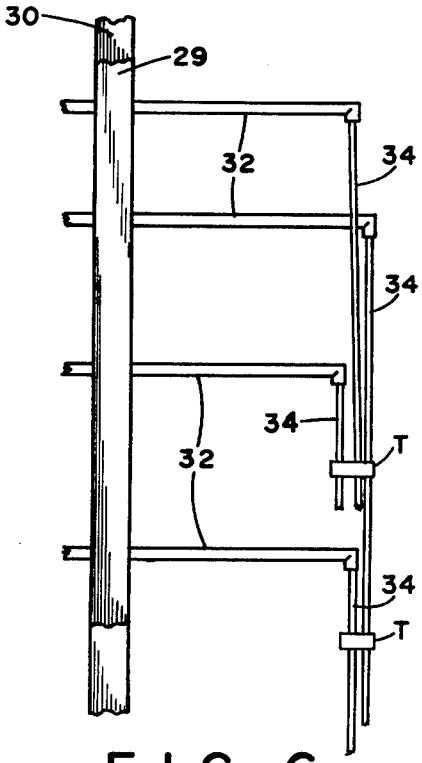

Dipoles 24 of the log-periodic antenna have lengths which vary from a maximum at the low frequency end of the antenna to a minimum at the high frequency end, the lengths of the dipoles being substantially greater than the width W of vehicle 11, see FIG. 3. In order to reduce the lengths of these dipoles when the antenna is in the stowed position, each element 24*a* and 24*b* of the longer dipoles is articulated. Each of such elements is structurally the same (except for length) and comprises an inner section 32 secured to one of conductive tubes 29 and 30, and an outer section 34 hinged to the outer end of inner section 32 for pivotal movement between the fully extended position shown in FIGS. 3 and 5 and the folded or collapsed position shown in FIGS. 4 and 6. Certain of the outer sections 34 of the elements are fitted with self-adhesive ties T which enable overlapping outer sections to be releasably secured or bundled together in the folded position, see FIG. 6. An example of the self-adhesive tie T useful in the practice of the invention is the commercially available product sold under the trademark "VELCRO" by Velcro U.S.A., Talon American, Stamford, Conn.

Figure 7:
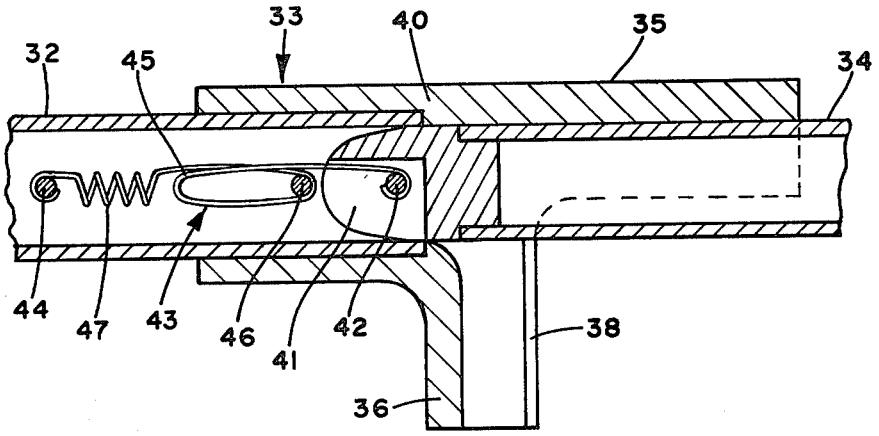
FIG. 7 is an enlarged fragmentary side elevation partly in section of a radiating element embodying the invention in the extended or operative position.
Figure 8:
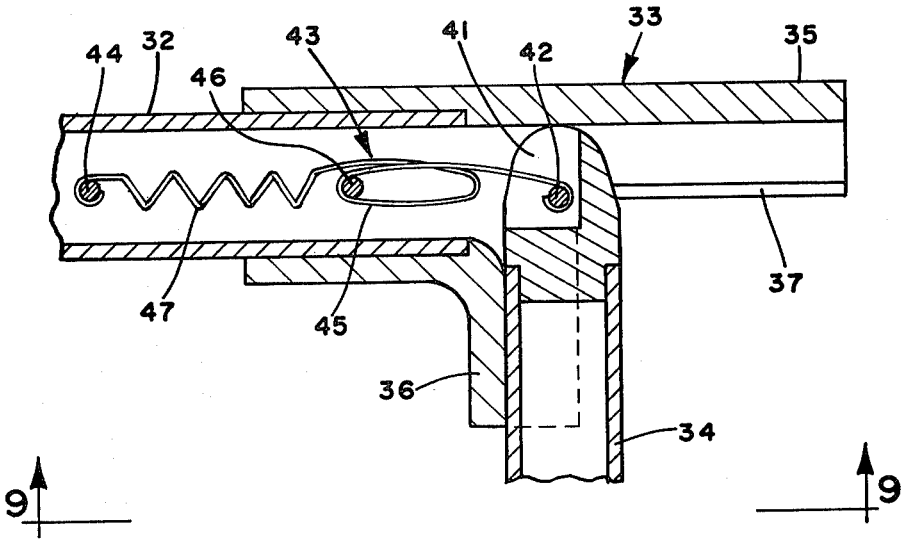
FIG. 8 is a view similar to FIG. 7 showing the radiating element in the stowed position.
Figure 9:
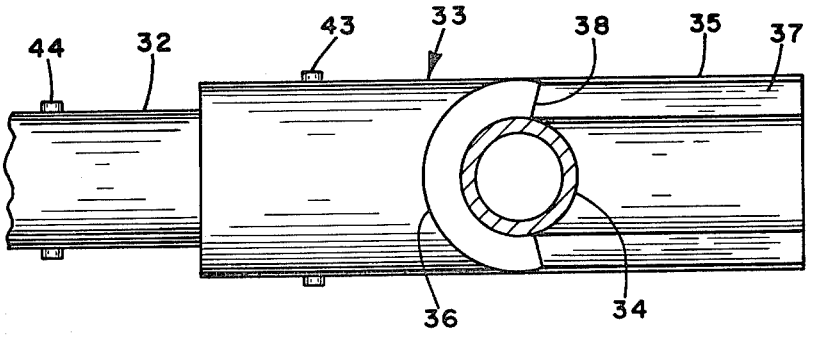
FIG. 9 is a view taken on line 9—9 of FIG. 8.

A preferred construction of the two-piece element 24*a* constituting one-half of the foldable dipole is shown in FIGS. 7, 8 and 9 and comprises the conductive cylindrical tubular inner section 32 secured to boom tube 29, a T-shaped conductive sleeve 33 telescoped over and secured to the outer end of section 32, and a cylindrical conductive outer section 34. Sleeve 33 has an outer longitudinal leg 35 and a transverse leg 36, preferably perpendicular to leg 35, the inside diameters of the legs being equal to the outside diameter of outer section 34. The walls of sleeve legs 35 and 36 having intersecting slots 37 and 38, respectively, each slot preferably having a width slightly less than 180 degrees.

Secured to the inner end of outer section 34 is a rounded tapered electrically conductive plug 40 having a maximum diameter slightly larger than the inside diameter of inner section 32 and adapted to fit snugly within the adjacent end thereof with limited penetration. Plug 40 is formed with a longitudinal slot or recess 41 and has a pin 42 secured thereto and extending transversely through slot 41. Outer section 34 is releasably connected to inner section 32 by a spring clip 43 anchored at its inner end to transverse pin 44 secured to section 32 and at its outer end to pin 42. Clip 43 is configured with a longitudinally elongated loop 45 through which extends a transverse guide pin 46 secured to section 32 and has a spring portion 47. Clip 43 is in tension at all times and holds plug 40 of outer section 34 tightly within inner section 32 when the outer section is in the extended or operative position as shown in FIG. 7. When it is desired to move outer section 34 from the extended position to the folded position (FIG. 8), outer section 34 is pulled outwardly from inner section 32 and thereafter pivoted (clockwise as viewed) into engagement with sleeve leg 36. Because slots 37 and 38 in the sleeve legs are less than 180° wide, outer section 34 is releasably clamped by the legs in both the extended and folded positions so as to eliminate play and to provide additional mechanical support to outer section 92 when in the extended position. Loop 45 in spring clip 43 also insures limited withdrawal of outer section 34 from inner section 32 to prevent damage to the spring. With this construction, outer section 34 is quickly and conveniently pivoted between extended and folded positions without disengaging the parts. The tight contact between plug 40 and inner section 32 and between sleeve 33 and inner section 32 and outer section 34 when the latter is in the extended position insures good electrical continuity across the joint.

What is claimed is:

1. An antenna having a boom with a longitudinal axis and at least one dipole supported on said boom and extending in a direction transversely of said axis, said dipole having two articulated electrically conductive elements, each of said elements comprising a hollow tubular inner section connected at one end to said boom, an outer section in electrical contact with and projecting from the other end of said inner section, spring means connected under tension between said outer and inner sections, said spring means exerting a compressive force between said sections and being yieldable to permit said outer section to be moved between an operative position colinear with said inner section and stowed position transversely of said inner section, and a T-shaped electrically conductive sleeve telescoped over and secured to the end of said inner section, said sleeve having a longitudinal leg projecting colinearly from said inner section, said sleeve leg having a slot therein, said outer section being disposed within said longitudinal leg when in said operative position and extending transversely thereof when in the stowed position.

2. The antenna according to claim 1 with said outer section in said operative position is partially telescoped within said other end of said inner section.

3. The antenna according to claim 1 in which the width of said slot is less than 180 degrees whereby said outer section in the operative position is releasably clamped by said longitudinal leg.

4. The antenna according to claim 1 in which said longitudinal and transverse legs have intersecting slots, each of said slots having widths less than 180 degrees whereby said outer section is releasably clamped by said legs in the operative and stowed positions, respectively.

5. The antenna according to claim 1 in which said spring means comprises a spring clip anchored at opposite ends to said inner and outer sections, respectively, said spring clip having a longitudinally elongated loop intermediate the ends thereof, and guide pin means secured to said inner section and extending through said loop.

6. The antenna according to claim 2 in which said outer section has a conductive plug secured to and projecting from the inner end thereof and adapted to extend into said inner section when the outer section is in the operative position, said plug having a tapered rounded shape with a maximum transverse dimension slightly larger than the inside diameter of said inner section whereby to limit penetration of said plug into said inner section.

7. The antenna according to claim 6 in which said plug has a longitudinal slot therein and a pin secured thereto extending transversely through said slot, said spring means being anchored to said pin.

8. The antenna according to claim 1 in which said boom has a longitudinal axis and a plurality of longitudinally spaced dipoles supported thereon, certain of said dipoles having said articulated elements, the outer sections of said elements on each side of said boom overlying each other in the stowed position, and means for releasably tying said overlying sections together.

* * * * *